US010094394B2

(12) United States Patent
Heli

(10) Patent No.: US 10,094,394 B2
(45) Date of Patent: Oct. 9, 2018

(54) FLOW RECTIFIER FOR AN AXIAL FAN

(71) Applicant: ebm-papst Mulfingen GmbH & Co. KG, Mulfingen (DE)

(72) Inventor: Thomas Heli, Langenburg (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 384 days.

(21) Appl. No.: 14/434,147

(22) PCT Filed: Aug. 13, 2013

(86) PCT No.: PCT/EP2013/067691
§ 371 (c)(1),
(2) Date: Apr. 8, 2015

(87) PCT Pub. No.: WO2014/056657
PCT Pub. Date: Apr. 17, 2014

(65) Prior Publication Data

US 2015/0330411 A1 Nov. 19, 2015

(30) Foreign Application Priority Data

Oct. 8, 2012 (DE) ..... 10 2012 109 542

(51) Int. Cl.
*F04D 29/66* (2006.01)
*F04D 29/54* (2006.01)
(Continued)

(52) U.S. Cl.
CPC ..... *F04D 29/667* (2013.01); *F04D 19/002* (2013.01); *F04D 29/325* (2013.01);
(Continued)

(58) Field of Classification Search
CPC .... F04D 19/002; F04D 29/325; F04D 29/563; F04D 29/644; F04D 29/667; F04D 29/542; F04D 29/547; F04D 29/544
See application file for complete search history.

(56) References Cited

U.S. PATENT DOCUMENTS 1,762,358 A 6/1930 Schmidt
2,100,994 A * 11/1937 Cohen ..... F04D 29/703 415/121.2

(Continued)

FOREIGN PATENT DOCUMENTS

DE 44 04 262 A1 8/1995
DE 10 2011 012 039 A1 8/2012

OTHER PUBLICATIONS

International Preliminary Report on Patentability for PCT/EP2013/067691 (dated Apr. 21, 2015).
PCT International Search Report—dated Jul. 21, 2014.

*Primary Examiner* — Justin Seabe
*Assistant Examiner* — Brian P Wolcott
(74) *Attorney, Agent, or Firm* — Brinks Gilson & Lione

(57) ABSTRACT

A flow rectifier (1) for an axial fan (2), having a base body (3) which has rings (4*a*, 4*b*, 4*c*, 4*d*, 4*e*) delimited radially inside the outside by cylindrical surfaces (5, 6). Air guide vanes (7) which are distributed in the circumferential direction about a longitudinal axis (X-X) arranged in a generally radial manner and extend between the cylindrical surfaces (5, 6). The air guide vanes (7), in the circumferential direction, extend with a curvature (R1) relative to the axial direction (X-X) between an inflow-side vane edge (7*a*) and an outflow-side vane edge (7*b*). In order to minimize the divergence of airflow from the flow rectifier (1), two or more rings (4*a*, 4*b*, 4*c*, 4*d*, 4*e*) having air guide vanes (7) are provided in the base body (3).

16 Claims, 3 Drawing Sheets

(51) Int. Cl.

| | |
|---|---|
| ***F04D 29/56*** | (2006.01) |
| ***F04D 29/32*** | (2006.01) |
| ***F04D 29/64*** | (2006.01) |
| ***F04D 19/00*** | (2006.01) |

(52) U.S. Cl.
CPC ..... *F04D 29/542* (2013.01); *F04D 29/544* (2013.01); *F04D 29/563* (2013.01); *F04D 29/644* (2013.01)

(56) References Cited

U.S. PATENT DOCUMENTS

| | | | | |
|---|---|---|---|---|
| 4,692,091 | A | 9/1987 | Ritenour | |
| 6,139,265 | A * | 10/2000 | Alizadeh | F04D 29/544 415/208.1 |
| 6,503,060 | B1 * | 1/2003 | Kamada | F04D 29/703 415/121.2 |
| 7,429,162 | B2 * | 9/2008 | Lee | F04D 25/0613 415/211.2 |
| 7,811,055 | B2 * | 10/2010 | Stommel | F01P 5/06 415/191 |
| 8,113,775 | B2 * | 2/2012 | Yoshida | F04D 25/0613 415/219.1 |
| 2002/0159883 | A1 | 10/2002 | Simon et al. | |
| 2005/0186070 | A1 * | 8/2005 | Zeng | F04D 29/544 415/211.2 |
| 2006/0147304 | A1 * | 7/2006 | Cho | F04D 29/544 415/191 |
| 2006/0257251 | A1 * | 11/2006 | Carlson | F04D 29/661 415/178 |
| 2008/0064319 | A1 * | 3/2008 | Chezick | F24F 13/085 454/341 |

* cited by examiner

FLOW RECTIFIER FOR AN AXIAL FAN

CROSS REFERENCE TO RELATED APPLICATIONS

This application claims priority to German Patent Application No. 10 2012 109 542.6, filed on Oct. 8, 2012; and PCT/EP2013/067691, filed Aug. 27, 2013.

FIELD OF THE INVENTION

The present invention relates to a flow rectifier for an axial fan, having a base body, which comprises a ring that is delimited radially inside and outside, in each case, by cylindrical curved surface areas, said ring having a plurality of air guide blades, which are distributed in the circumferential direction about a longitudinal axis, and which are disposed in an essentially radial manner such that they extend between the curved surface areas, wherein, when viewed in a circumferential direction, the air guide blades extend with a curvature relative to the axial direction, in each case extending between an inflow-side blade edge and an outflow-side blade edge, wherein two or more rings are provided in the base body, said rings having a plurality of air guide blades, which are distributed in a circumferential direction about the longitudinal axis, and which are disposed in an essentially radial manner such that they extend between the curved surface areas, wherein at least one of the blade edges of the air guide blades has an adjustable height in the radial direction.

BACKGROUND

A flow rectifier of the above described kind is an air directing element, which is disposed with the air guide blades thereof directly behind an axial fan in order to redirect the air that has been set in motion by the impeller of the axial fan in a flow that is as axial and as uniform as possible. An air directing element of this kind is frequently also referred to as a "streamer".

Axial fans are used, among other things, in evaporators in cold storage rooms, where the cold air is distributed by an axial fan via a heat exchanger into the cold storage room. In the case of large cold storage rooms, it is important that the cold air be transported as far as possible into the room in order that refrigerated products located at a great distance can also be cooled. To this end, an axial fan is needed that provides the greatest possible volumetric flow with a large trajectory distance. Here, a trajectory is understood to be a distance up to which a critical velocity of the air flow is maintained. This trajectory is limited due to the swirl-impaired outflow of an axial fan. The trajectory distance can be significantly increased with the help of a downstream flow rectifier, which transforms the swirling movement back into a uniform, axial flow. It is important here that the flow rectifier have as little flow resistance as possible so that only an insignificant degree of pressure drop occurs in the quantity of air flowing therethrough.

A flow rectifier of the aforementioned type, which essentially fulfills the requirements specified above, is known from DE 44 04 262 A1. A reduction in the swirling movement of the flow medium is achieved here in particular by the fact that, viewed in the circumferential direction, the air guide blades each extend with a curvature relative to the axial direction between an inflow-side blade edge and an outflow-side blade edge. In a special embodiment, it is also provided here that one of the blade edges, and specifically the edge on the front of the guide blade, has an adjustable height in the radial direction. Said blade edge is designed such that it is straight, and extends at an angle to the central axis of the impeller. An effect possibly associated with this design is not described.

A disadvantage to this known flow rectifier is that an actually uniform, axial flow only arises at a considerable distance from the fan or from the exit out of the guide wheel. In this way, as shown in FIG. 1 contained in DE 44 04 262 A1, while an angle between the air flow and the fan axis in a peripherally located optimal region of the radial length of the air guide blades of the flow rectifier is virtually zero, this angle nevertheless increases rather quickly radially outward and, in particular, radially inward therefrom. This results in a diverging air flow. In the case of the given diameter of the cylindrical curved surface areas of the walls, which delimit the ring of the air guide blades radially inside and outside, there is only one optimum blade length from the standpoint of rendering the flow of fluid uniform, which length, according to DE 44 04 262 A1, was determined through extensive aerodynamic measurements using a Conrad sensor. In addition, when using the known flow rectifier, a combination of said rectifier with a protective grill is necessary in order to ensure protection against accidental contact.

In addition, US 2005/0186070 A1 discloses a fan assembly including an impeller, which is disposed on the rotor of a motor. The impeller is surrounded by a housing, wherein the housing comprises a flow rectifier disposed behind the impeller in the direction of flow. The blades of the flow rectifier have a consistent height in the radial direction.

The object of the present invention is to create a flow rectifier of the above-mentioned type, using which the aforementioned disadvantages can be overcome while achieving a high volumetric flow and large trajectory distance.

INTRODUCTORY DESCRIPTION OF THE INVENTION

The above described object is achieved according to the invention in that the blade edge of the air guide blade, which has adjustable height in the radial direction, has a curvature.

As a result of this radial segmentation of the cross section of the flow rectifier as provided, it is advantageously possible to effectively prevent a swirling movement of the flowing gas in the outflow of an axial fan with a consistently high volumetric flow. Compared to the prior art, a uniform flow pattern arises at a lesser distance from the flow rectifier, and the trajectory distance is increased. In this way, a significant divergence of the air flow exiting the flow rectifier according to the invention can be effectively prevented through an increased number of bladed rings. In the case of the changing dimensions, for example of the inner and outer diameter of the axial impeller of the fan and therefore of the length of the blades, as a result of which, there are corresponding changes to the dimensions of the flow rectifier, no extensive measurements and/or optimization calculations need to be performed, since bladed rings each having the same radial width and known efficiency can be lined up adjacent to one another.

In the case of the curvature relative to the axial direction, which each of the air guide blades has, viewed in a circumferential direction, between the inflow-side blade edge thereof and the outflow-side blade edge thereof, the inflow angle of the blade may thereby be selected such that it essentially corresponds to the outflow angle of the axial fan, and the outflow angle of the blades may be selected such that, in this region, the blade is designed such that it is parallel to an air flow direction, which extends in the direction of the longitudinal axis. The respective inflow angles of the air guide blades may all be identical in the rings, or alternatively, may vary from ring to ring, and in particular, may vary as a function of the outflow profile of the flow medium leaving the fan.

As a result of selecting an appropriate number of rings having air guide blades, selecting the number of air guide blades themselves and, alternatively or additionally, as a result of an effective height of the blading, and thus the configuration of the air guide blades of the rectifier according to the invention, it is possible for the rectifier according to the invention to also assume the function of providing protection against accidental contact with the impeller. It is thus possible to omit an additional safety grill, because the openings present between the walls of the ring and the air guide blades are designed such that they are small enough or, in particular, the axial length of the rectifier is designed such that it is large enough that it is not possible to reach a hand or an individual finger through to the rotating impeller. In this way, a safe distance from a rotating impeller of the axial fan is ensured.

Here, the number of air guide blades may be decreased from the outer rings to the inner rings, in order to make it possible in this manner to implement a nearly identical spacing between the respective blades of a row in each ring, and thus make it possible to achieve the lowest possible flow resistance. The flow rectifier according to the invention may be designed one-part in a less-expensive manner in terms of manufacturing, preferably as an injection-molded part made from plastic. Here it may advantageously be designed such that said flow rectifier may be subsequently releasably mounted on a wall ring or on a protective or supporting grid of an already existing fan. In so doing, the fastening may be designed such that the flow rectifier can be removed from the fan with only very few manual movements, and can be easily cleaned, for example in a dishwasher.

By a suitable choice of materials and an appropriate dimensioning of the axial length of the flow rectifier according to the invention, it is also possible to ensure a high degree of robustness with respect to externally acting mechanical stresses. Thus when using the flow rectifier according to the invention in combination with a evaporator fan, it is possible to forcibly remove ice that has formed on the surface, for example using a screwdriver, without damaging the structure of the rectifier. In particular, the relevant strength requirements according to the so-called ball impact test (e.g. according to UL 2218) of Underwriters Laboratories can also be fulfilled. Specifically, during this test, a standardized steel ball having a diameter of approximately 50 mm is dropped in free-fall from various heights (different levels of severity, e.g., 0.38 m, 1.2 m etc.) onto the flow rectifier. Here, the flow rectifier must survive the impact such that the protective function against accidental contact with rotating and electrical parts is fully retained.

One of the blade edges, and specifically, in particular the edge on the reverse side of the air guide blade, may preferably have an adjustable height in the radial direction. Here in particular the end of the blade facing the outflow direction may have an edge, which does not extend in a straight line, but instead is provided with a radius, in particular in order to minimize noise.

A third ring may thus be introduced concentrically between two bladed rings, which third ring forms a transition between the two rings, by having a reduced axial length, and thus being connected to the curved end of the blade. In this way, every second bladed ring may have a reduced axial length as compared to another ring adjacent to it.

BRIEF DESCRIPTION OF THE DRAWINGS

Advantageous embodiments of the invention are will be explained in greater detail on the basis of exemplary embodiments depicted in the accompanying drawings.

FURTHER DESCRIPTION OF THE INVENTION

Figure 1:
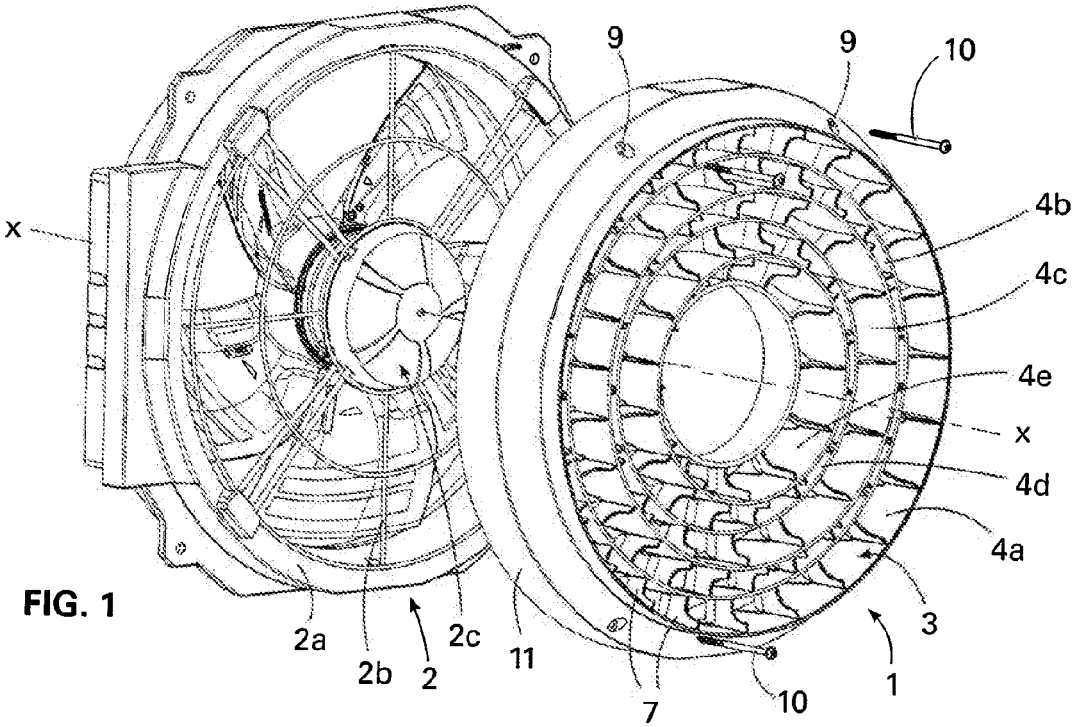
FIG. 1 shows an exploded view in perspective of a preferred embodiment of a flow rectifier according to the invention, together with an axial fan.

In the Figures shown in the drawings, the same parts or functionally equivalent parts are identified using the same reference numbers. Insofar as certain features of the flow rectifier according to the invention or components thereof that have been described, and/or which can be gathered from the drawings, are mentioned only in connection with the exemplary embodiment, these features are nevertheless significant according to the invention and independent of this embodiment as a single feature, or also in combination with other features of the exemplary embodiment, and may be claimed as pertinent to the invention.

Figure 2:
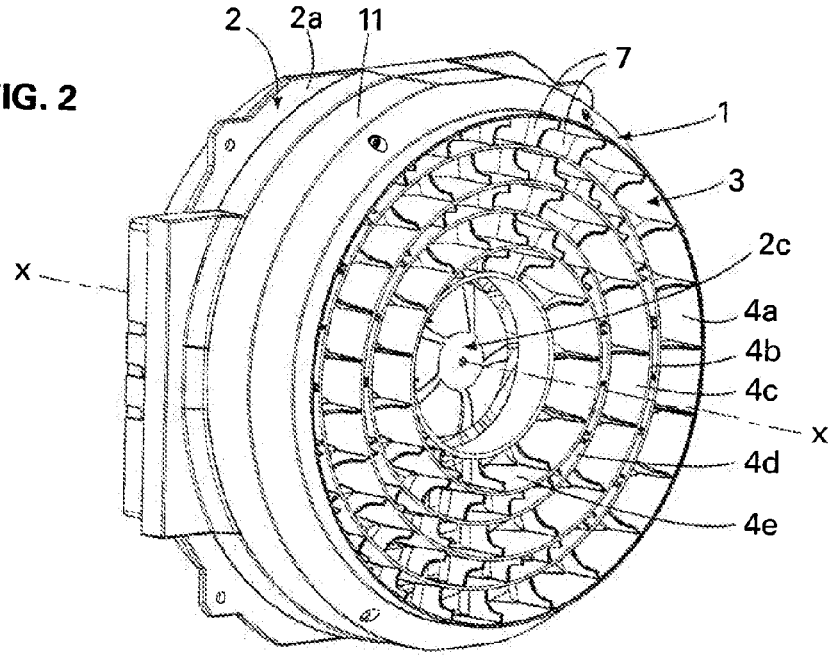
FIG. 2 shows the flow rectifier according to the invention depicted in FIG. 1 in an assembled state on the axial fan.

First, as FIGS. 1 and 2 show, a flow rectifier 1 according to the invention is designed to be used in combination with an axial fan 2. This may occur, in particular in the case of complex cooling applications, when an optimal air distribution in a cold storage room is critical, wherein all of the products that are to be cooled must be subjected to a uniform flow of circulated air. The advantage to using a flow rectifier 1 according to the invention in a cold storage room is, in particular, that a stronger, more bundled air stream having a greater trajectory distance can be provided through the use of said flow rectifier in combination with the axial fan 2.

As shown, the axial fan 2 may be designed, in particular, as a so-called wall ring fan and may comprise a wall ring 2*a* having a supporting grid 2*b*, in which a fan unit 2*c* is held. In this case, the fan unit 2*c* has a motor, in particular an external rotor motor, the rotor of which is integrated directly into an axial impeller in a preferred embodiment. The supporting grid 2*b* of the axial fan 2, which serves as a support for the ventilator unit 2*c*, may be designed such that it is wide-meshed, since it need not fulfill the function of a protection against accidental contact, because this function is assumed by the flow rectifier 1.

Figure 3:
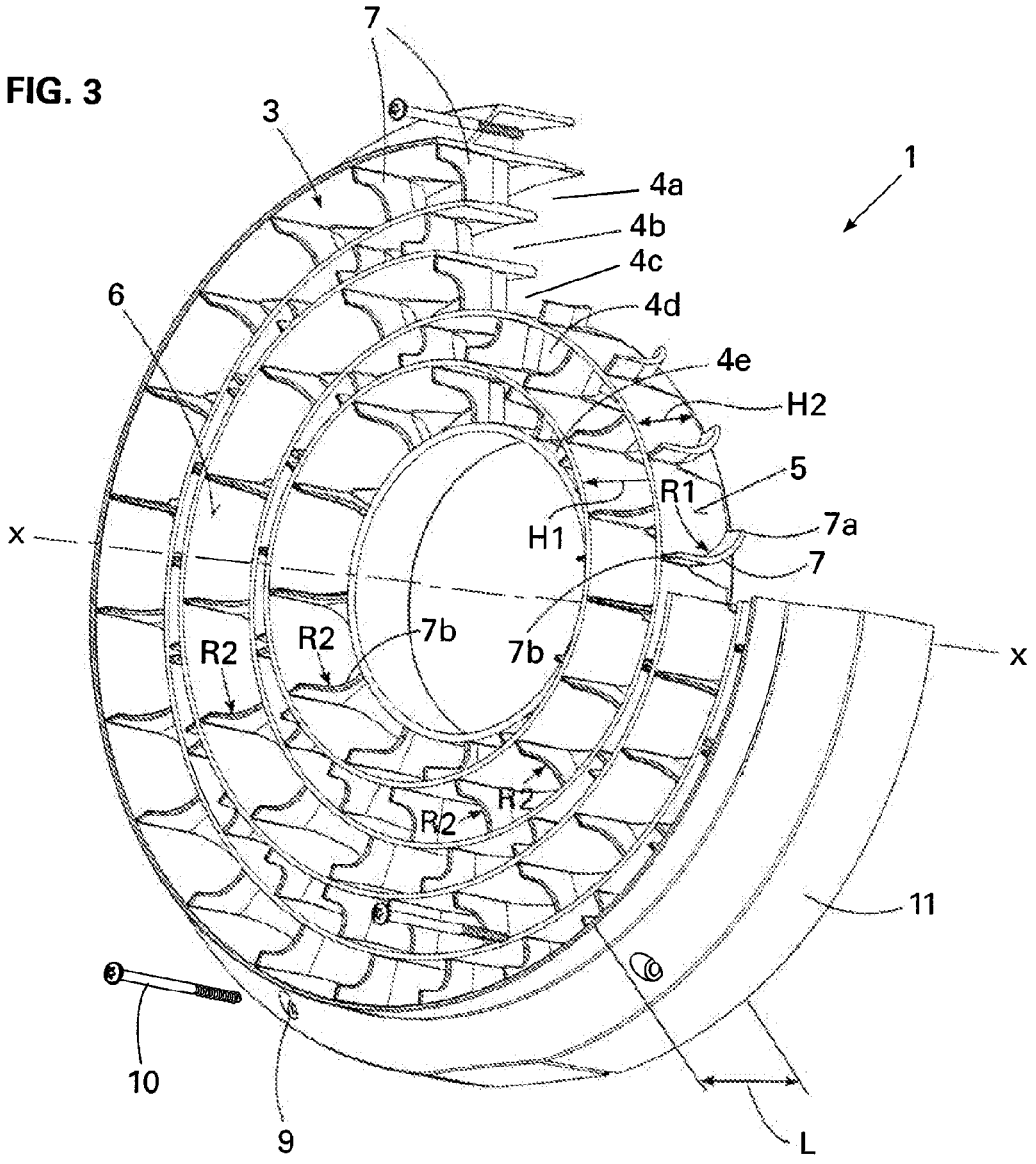
FIG. 3 shows a partial sectional view in perspective of a flow rectifier according to the invention that has been enlarged as compared to FIGS. 1 and 2.
Figure 4:
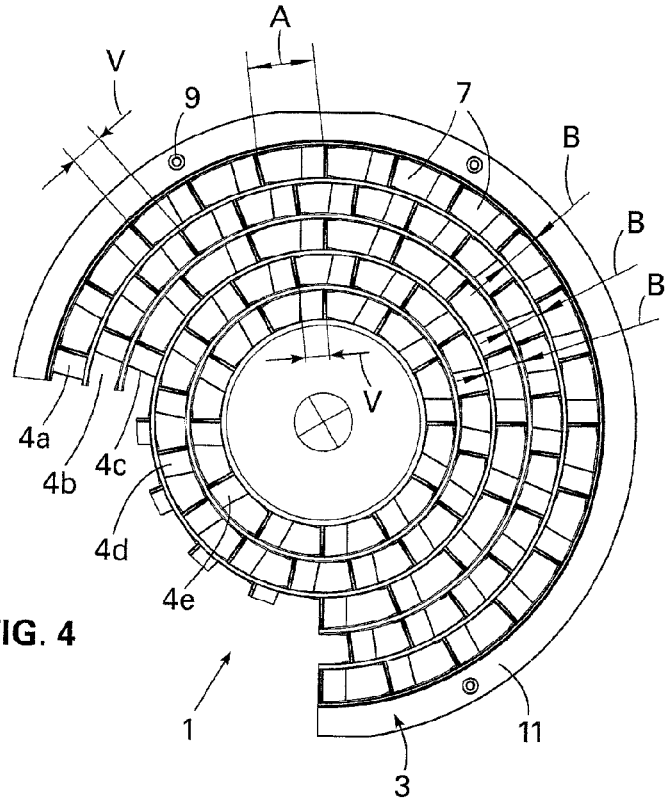
FIG. 4 shows a front view of the flow rectifier according to the invention.
Figure 5:
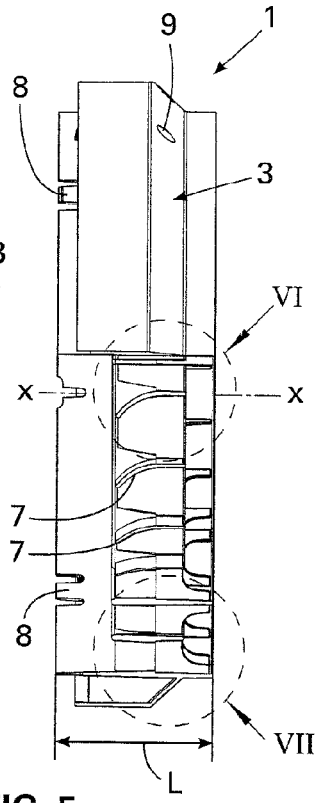
FIG. 5 shows a longitudinal view with a partial cut away of the embodiment of the flow rectifier according to the invention according to FIG. 4, FIGS. 6 and 7 show a substantially enlarged view of the details of the flow rectifier according to the invention designated as VI and VII in FIG. 5.

As shown in FIGS. 3 through 5, in addition to FIGS. 1 and 3, a flow rectifier 1 according to the invention includes a base body 3, which comprises at least two, preferably, however, more rings, which number five rings including first ring 4*a*, second ring 4*b*, third ring 4*c*, fourth ring 4*d*, and fifth ring 4*e* in the depicted embodiment. Each ring 4*a*, 4*b*, 4*c*, 4*d*, and 4*e* is delimited radially inside and outside by a cylindrical curved surface area. In this regard only in FIG. 3, by way of example, an inner curved surface area of the middle ring 4*d* is designated with the reference number 5, and the opposite, outer curved surface area of the middle ring 4*d* is designated with the reference number 6.

Located in each ring 4*a*, 4*b*, 4*c*, 4*d*, and 4*e* is a plurality of air guide blades 7, which are distributed in a circumferential direction about a longitudinal axis X-X of the flow rectifier 1, and which are disposed in an essentially radial manner, in each case extending between the curved surface areas 5, 6 of the rings 4*a*, 4*b*, 4*c*, 4*d*, and 4*e*. Viewed in a circumferential direction, the air guide blades 7 here each extend simultaneously starting from an inflow-side blade edge 7*a* and ending in an outflow-side blade edge 7*b* ending in a circumferential direction such that they are curved with respect to an axial direction X-X; here, reference is made, in particular, to the sectional view of the ring 4*c* in FIG. 3 by way of example. As a result of the curvature R1 with respect to the axial direction X-X, which may be determined by a circular arc, for example, it is, in particular, possible to make the inflow angle $\mu_z$ of the air to the air guide blade 7 at the inflow-side blade edge 7*a* great enough that said angle essentially corresponds to an outflow angle $\mu_A$ of the air that is affected by a swirling movement, out of the axial fan 2, while the outflow angle $\mu_A$ of the air from the air guide blades 7 at the outflow-side blade edge 7*b* is selected in such a way that, in this region, the air guide blade 7 extends parallel to an air flow direction that extends in the direction of the longitudinal axis X-X. This feature is also most clearly evident in FIG. 6.

Figure 6:
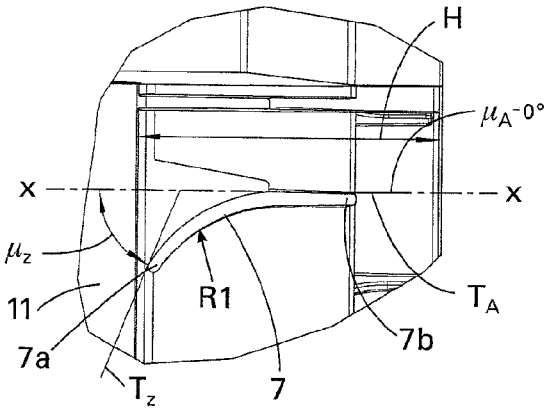

As is shown in FIG. 6, the inflow angle $\mu_z$ of the air to the air guide blade 7 is defined as the acute angle between a tangent $T_z$ drawn to the inflow-side blade edge 7*a* and the longitudinal axis X-X. This inflow angle may preferably fall in the range of $20° \leq \mu_z \leq 80°$. In the same way, the outflow angle $\mu_A$ is defined by a tangent $T_A$ drawn to the outflow-side blade edge 7*b*, and preferably has the value of 0°. In particular, the inflow angle $\mu_z$ may be identical in all of the air guide blades 7 that are located in a ring 4*a*, 4*b*, 4*c*, 4*d*, and 4*e*, however said angles may differ from the inflow angle $\mu_z$ of the air at an air guide blades 7 in another ring 4*a*, 4*b*, 4*c*, 4*d*, and 4*e*. In this way, the inflow angle $\mu_z$ may be varied from ring 4*a*, 4*b*, 4*c*, 4*d*, and 4*e* to ring 4*a*, 4*b*, 4*c*, 4*d*, and 4*e* as a function of the outflow profile of the air leaving the axial fan 2.

In the depicted exemplary embodiment of the flow rectifier 1 according to the invention, the respective inflow angle $\mu_z$ of the air to all air guide blades 7 is the same value. By selecting the appropriate number of rings 4*a*, 4*b*, 4*c*, 4*d*, and 4*e*, each having the same width B, said rings having air guide blades 7 (see FIG. 4), and by selecting the number of air guide blades 7, which number decreases from ring 4*a*, 4*b*, 4*c*, 4*d*, and 4*e* to ring 4*a*, 4*b*, 4*c*, 4*d*, and 4*e* from the outside to the inside, it is possible to design all air guide blades 7 and spaces, wherein the air guide blades 7 are each located or, respectively, the mutual spacing of the air guide blades 7 from one another, such that these are nearly uniform and of the same size, and therefore in the same way, to contribute to an increase in efficiency in terms of the desired effect of the reduction in the swirling movement and an increase in the trajectory distance as well.

In this way, a flow rectifier 1 according to the invention can also be designed having a very stable honeycomb structure, the stability of which is additionally increased when, as depicted and in particular, designated with reference characters in FIG. 4, the inflow-side blade edges 7*a* and the outflow-side blade edges 7*b* of the air guide blades 7 in the respective, adjacently located rings 4*a*, 4*b*, 4*c*, 4*d*, and 4*e* are disposed having a circumferential offset (V) relative to one another. In so doing, the respective spacing A, at which the air guide blades 7 are disposed relative to one another, may preferably be identical. In this regard, the distance between two adjacently located inflow-side edges 7*a* is indicated as such a distance A in FIG. 4 by way of example.

Figure 7:
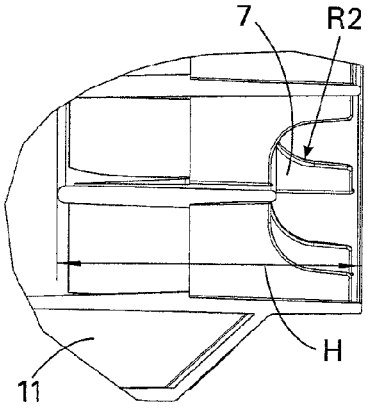

It is also possible for the flow rectifier 1 according to the invention to assume the function of providing protection against accidental contact, by selecting an appropriate number of rings 4*a*, 4*b*, 4*c*, 4*d*, 4*e* having air guide blades 7, the number of the air guide blades 7 themselves and alternatively or additionally, also by means of the total height H of the blading (cf. FIGS. 6 and 7), through which the axial length of L of the flow rectifier 1 according to the invention is substantially influenced.

In order to improve the release behavior of the air from the blades 7, as well as the noise reduction associated therewith, in the depicted embodiment, it is provided that the outflow-side blade edges 7*b* have an varying height in the radial direction, in particular a constantly changing height. In so doing, it is provided that the outflow-side blade edges 7*b* of the air guide blades 7 have a curvature R2 for the varying height in a radial direction, which curvature, like the blade curvature R1 in the circumferential direction, can likewise preferably be described by a circular arc.

A further preferred feature of the flow rectifier 1 according to the invention is that, in the radial sequence of the rings 4*a*, 4*b*, 4*c*, 4*d*, and 4*e* having the air guide blades 7, the rings 4*a*, 4*b*, 4*c*, 4*d*, 4*e* each have different and, in particular, two alternating heights H1, H2. A ring (rings 4*b*, 4*d*) is inserted concentrically between each pair of blade rows (rings 4*a*, 4*c*, 4*e*), the blades of which peripherally having a greater height H1, said height decreasing radially inward over the width of the rings 4*a*, 4*c*, 4*e*, which ring is reduced in height H2, wherein the height of the blades again increases over the width of the ring B radially inward. As a result, the release from the air guide blades 7 is thereby improved and the flow resistance is reduced in an optimal manner, with constant total axial length L of the flow rectifier 1 according to the invention, for example selected on the basis of providing protection against accidental contact. The course of the radial curvature R2 of the outflow-side blade edges 7*b* of the air guide blades 7, using the height, which is adjustable in the radial direction, may be adjusted, preferably on each blade, may thereby extend in such a way that the radial curvatures in adjacently located rings 4*a*, 4*b*, 4*c*, 4*d*, and 4*e* are a mirror image of one another.

That means, for example, that, as is made particularly evident in FIG. 3, when a convexity in the contour of the blade edge 7*a* radially outward exists in a ring 4*c*, which is delimited radially outside by a wall having a greater height H1 (outer curved surface area 6) and is delimited radially inside by a wall having a lesser height H2 (inner curved surface area 5), said convexity being caused by the curvature R2, it follows that there is a convexity in the contour of the blade edge 7*a* in adjacent ring 4*d*, which is delimited radially outside by a wall having the lesser height H2, and which is delimited radially inside by a wall having a greater height H1, said convexity being caused by the curvature R2, and being a mirror image of the curvature R2 in the adjacent ring 4*c* with reference to the wall between the rings 4*c* and 4*d*. In the case of a reduced material usage for the flow rectifier 1 according to the invention due to the reduced height H2, this structural configuration can counteract back turbulence in the flowing air, since this air is guided as far as the greater height H1 with the formation of a laminar boundary layer at the air guide blades 7.

The invention is not limited to the embodiments that are depicted and described. As depicted as preferred, the base body 3 of a flow rectifier 1 according to the invention may preferably be designed one-part, and preferably designed as an injection-molded component made out of plastic, however a multi-part design, possibly made from a metallic material, also falls within the scope of the invention. Moreover, the person skilled in the art may also provide additional, technically useful measures without going beyond the scope of the invention. Thus catch 8, and opening 9 may be provided on the base body 3 for releasable attachment to the axial fan 2, in particular for example, a catch 8 for connection to a wall ring (2*a*) associated with the axial fan 2 and/or mounting openings 9, through which screws 10 serving as the screw connection to the fan 2 may pass. A connection section or, respectively, covering section 11 for the axial fan 2, which contributes to increasing the axial length, and which therefore should be designed having the shortest length possible, may also be provided on a flow rectifier 1 according to the invention, as shown.

The total height H of the blading may optimally fall in the range of 25 mm to 100 mm, which here corresponds to a size that falls in the range of 5% to 40% of the size of the outer diameter of the axial fan.

While the above description constitutes the preferred embodiment of the present invention, it will be appreciated that the invention is susceptible to modification, variation and change without departing from the proper scope and fair meaning of the accompanying claims.

The invention claimed is:

1. A flow rectifier for an axial fan, having a base body, comprising two or more rings arranged in a radial sequence, each delimited radially by cylindrical inside and outside curved surface areas, a plurality of air guide blades, which are distributed in a circumferential direction about a longitudinal axis, and which are disposed in a generally radial manner such that they extend between the curved surface areas, wherein, when viewed in a circumferential direction, the plurality of air guide blades extend with a first curvature relative to an axial direction, each air guide blade extending between an inflow-side blade edge and an outflow-side blade edge, and wherein the plurality of air guide blades have an axial height that varies in a radial direction such that the outflow-side blade edges of each air guide blade follow a radial path that defines defining a second curvature that is a circular arc-shaped curvature, wherein the second curvature has a first end portion extending generally parallel to the axial direction and a second end portion extending generally parallel to the radial direction.

2. A flow rectifier according to claim 1, wherein the varying axial height in the radial direction of each outflow-side blade edge has a constantly changing height.

3. A flow rectifier according to claim 1, wherein the first curvature relative to the axial direction, of each of the plurality of air guide blades, when viewed in a circumferential direction, between the inflow-side blade edge thereof and the outflow-side blade edge, an inflow angle ($\mu_z$) of air to each of the plurality of air guide blades is selected such that the inflow angle corresponds to an outflow angle ($\mu_A$) of the air out of the axial fan, on which the base body is mounted, and in that the outflow angle ($\mu_A$) of the air from each of the plurality of air guide blades is selected such that, each air guide blade is configured to extend parallel to an air flow direction, which extends in a direction of the longitudinal axis.

4. A flow rectifier according to claim 3, wherein the respective inflow angle ($\mu_z$) of the air is identical at all air guide blades.

5. A flow rectifier according to claim 3, wherein the respective inflow angle ($\mu_z$) of the air is identical at all of the air guide blades that are located in a first of the two or more rings and wherein the inflow angle is the same as or differs from the respective inflow angle ($\mu_z$) of the air at all of the air guide blades in a second of the two or more rings.

6. A flow rectifier according to claim 5, wherein the respective inflow angle ($\mu_z$) of the air at the plurality of air guide blades varies from the first ring to the second ring as a function of an outflow profile of the air leaving the axial fan.

7. A flow rectifier according to claim 1, wherein the base body is designed as a one-part, molded component made from plastic.

8. A flow rectifier according to claim 1, wherein fastener elements are provided on the base body for releasable attachment to the axial fan.

9. A flow rectifier according to claim 1, wherein the number of air guide blades disposed within a ring of the two or more rings decrease from one of the two or more rings to another of the two or more rings moving radially inward, so that substantially uniform circumferential spacing between respective air guide blades exists in each of the two or more rings.

10. A flow rectifier according to claim 1, wherein in the radial sequence of the two or more rings with the plurality of air guide blades, the rings each have different heights, which each alternate from each of the two or more rings.

11. A flow rectifier according to claim 10, wherein the radial path of the second curvature of each of the plurality of blade edges, using the axial height, which varies in the radial direction, is configured such that the second curvatures of each of the plurality of blade edges in adjacently located rings are a mirror image of one another.

12. A flow rectifier according to claim 1, wherein in the radial sequence of the two or more rings, the inflow-side blade edges and the outflow-side blade edges of the plurality of air guide blades in adjacently located rings are disposed having a circumferential offset relative to one another.

13. A flow rectifier according to claim 8, further comprising the fastener elements in the form of a catch means for connection to a wall ring associated with the axial fan through mounting openings, through which screws serving as a screw connection to the axial fan may pass.

14. A flow rectifier according to claim 8, wherein the two or more rings comprise a first ring, a second ring, and a third ring with the plurality of air guide blades extending between the first ring and the second ring, and between the second ring and the third ring.

15. A flow rectifier according to claim 8, wherein the two or more rings comprise a first ring, a second ring, a third ring, and a fourth ring with the plurality of air guide blades extending between the first ring and the second ring, between the second ring and the third ring, and between the third ring and the fourth ring.

16. A flow rectifier according to claim 8, wherein the two or more rings comprise a first ring, a second ring, a third ring, a fourth ring and a fifth ring, with the plurality of air guide blades extending between the first ring and the second ring, between the second ring and the third ring, between the third ring and the fourth ring, and between the fourth and the fifth ring.

* * * * *